United States Patent [19]

Clark et al.

[11] Patent Number: 4,478,466

[45] Date of Patent: Oct. 23, 1984

[54] LOCKABLE STORAGE SYSTEM

[75] Inventors: Leonard R. Clark, Oreland; David W. Meehl, Hatboro, both of Pa.

[73] Assignee: SPS Technologies, Inc., Newtown, Pa.

[21] Appl. No.: 377,276

[22] Filed: May 12, 1982

[51] Int. Cl.[3] ..... E05C 15/04

[52] U.S. Cl. ..... 312/215; 312/217; 312/218; 312/221; 312/222

[58] Field of Search ..... 312/215, 216, 217, 218, 312/219, 220, 221, 107.5, 111; 211/86

[56] References Cited

U.S. PATENT DOCUMENTS

| | | | |
|---|---|---|---|
| 486,455 | 11/1892 | Feige | 312/217 |
| 505,799 | 9/1893 | Brown | 312/220 |
| 921,895 | 5/1909 | Sampson | 312/218 |
| 1,909,848 | 5/1933 | Rand | 312/218 |
| 1,951,628 | 3/1934 | Prost | 312/218 |
| 2,559,579 | 7/1951 | Abrahamson | 312/219 |
| 3,602,564 | 8/1971 | Lewin | 312/222 |
| 3,622,216 | 11/1971 | Haunost | 312/222 |
| 3,828,937 | 8/1974 | Nash | 211/86 |
| 3,964,810 | 6/1976 | Murphy | 312/111 |
| 4,080,813 | 3/1978 | McKann | 70/461 |

FOREIGN PATENT DOCUMENTS

| | | | |
|---|---|---|---|
| 211977 | 4/1960 | Switzerland | 312/221 |
| 756583 | 9/1956 | United Kingdom | 312/218 |

*Primary Examiner*—Victor N. Sakran

*Attorney, Agent, or Firm*—Aaron Nerenberg; Gregory J. Winsky

[57] ABSTRACT

A storage system utilizing both shelving and drawers mounted between supports in which the drawers may be locked individually or in concert for security purposes. The shelves are mounted to the support members above a number of drawers slidably mounted between the support members. A locking channel, adjustable in length to accommodate the number of drawers desired, is slidably mounted within a similarly adjustable housing at the rear of the storage system to engage operatively pawls mounted at the rear of the drawers. The locking channel is moved vertically by a spring-biased locking mechanism causing openings in the locking channel to come into proper alignment so that the locking channel engages the pawls to lock the drawers in concert or disengages from the pawls to unlock the drawers in concert. The angular design of the pawl arms allows drawers remaining open during the locking procedure to be individually closed and locked thereafter. Panels are employed between the support members to cover the top, open sides and backs of the drawers in order to provide security.

2 Claims, 9 Drawing Figures

FIG. 4.
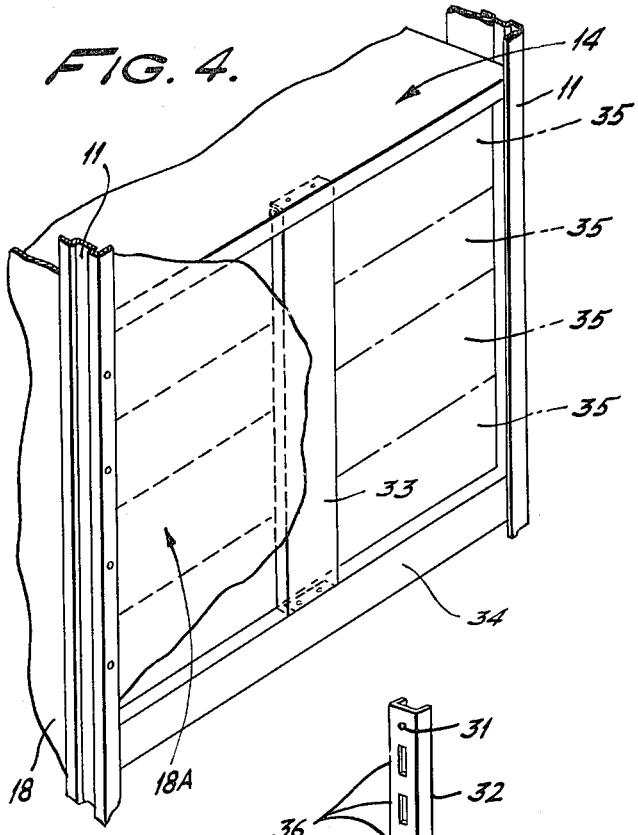
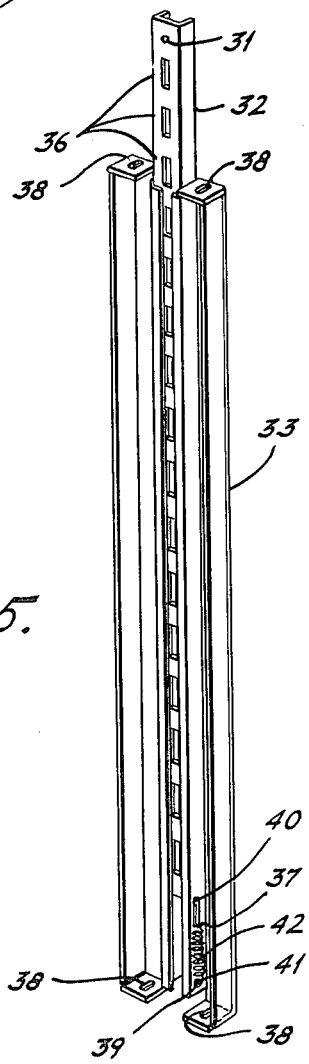
FIG. 5.
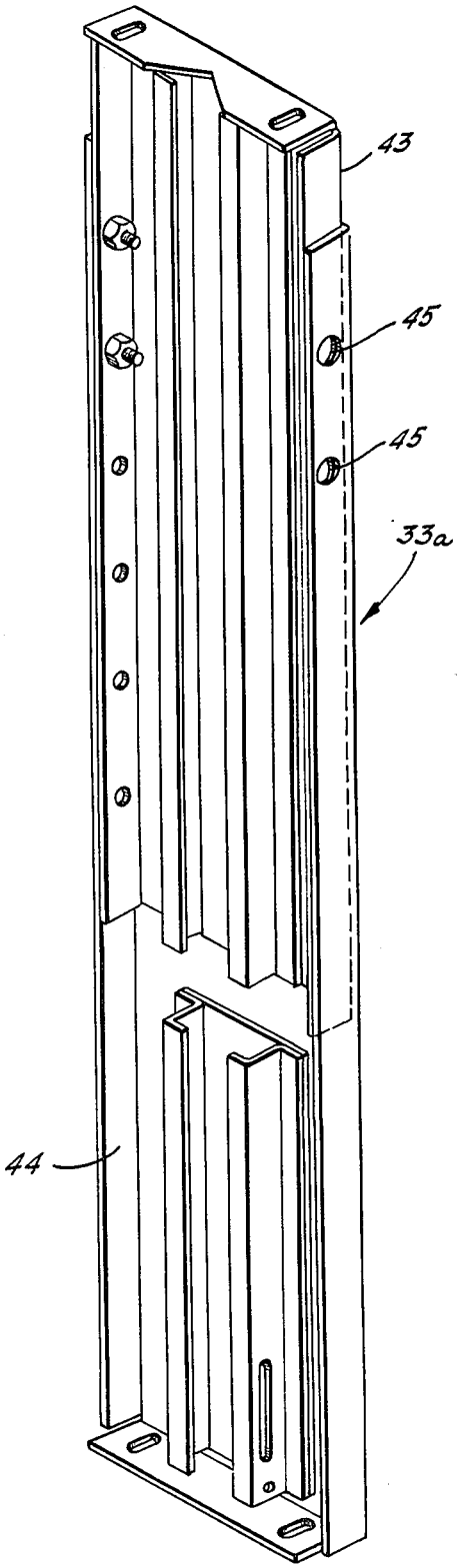
FIG. 6.

LOCKABLE STORAGE SYSTEM

BACKGROUND OF THE INVENTION

The present invention relates to a system for storing a variety and number of different size and shape articles, utilizing both open shelves and closed drawers, the drawers being lockable to provide secure storage for certain more valuable and usually smaller articles.

The need and desire to store in one general area different types, sizes and shapes of articles whether inventory, spare parts, or the like in industrial, merchandising, or domestic environments has led to the use of slidable drawers mounted in shelving units. For example, U.S. Pat. No. 3,828,937 issued to Nash on Aug. 13, 1974 shows the use of drawers in close proximity to shelves both mounted in an adjustable pole support system. Nash, however, does not teach nor suggest the locking of such drawers for security purposes. The diversity of articles currently being stored in this manner has created a problem of security with regard to storing higher value articles in the same general area with other articles of lesser value. This is especially true in areas such as the electronics industry in which many small parts and articles to be stored may have higher value than the larger items with which they are stored. The ability to lock such drawers is therefore highly desirable. Secondly, one of the attributes of using drawers mounted in shelving that must not be overlooked in providing this locking ability is the flexibility of storage design accorded by the movable nature of shelves and the relative ease of adding drawers to or taking drawers away from a shelving unit. Therefore, it has become desirable to provide a locking mechanism for security of higher value, usually smaller items storable in drawers and to make that locking mechanism adjustable so as to mesh with the desired design flexiblity of a combined shelving and drawer storage system, that is to say that as drawers are taken from such a storage system, the locking mechanism can be adapted to lock the remaining drawers.

Consequently, it is an object of this invention to provide a storage system that utilizes both shelving and drawers wherein the drawers may be locked.

It is a further object of this invention to provide a locking mechanism that will act to lock a number of drawers in concert or to close and lock any drawer individually after the unit has been locked.

Finally, it is an object of this invention to provide an adjustable locking mechanism which affords some measure of flexibility in the storing user's design of the position and number of shelves and lockable drawers.

BRIEF DESCRIPTION OF THE DRAWINGS

FIG. 4 is a rear perspective view of a locking assembly as it is mounted behind the drawers in the unit shown in FIG. 1.

FIG. 5 is a front perspective view of the locking assembly of FIG. 4, showing a locking channel slidably mounted in a locking channel housing.

FIG. 6 is a front perspective view of an alternative adjustable form of locking channel housing.

DESCRIPTION OF THE PREFERRED EMBODIMENTS

Figure 1:
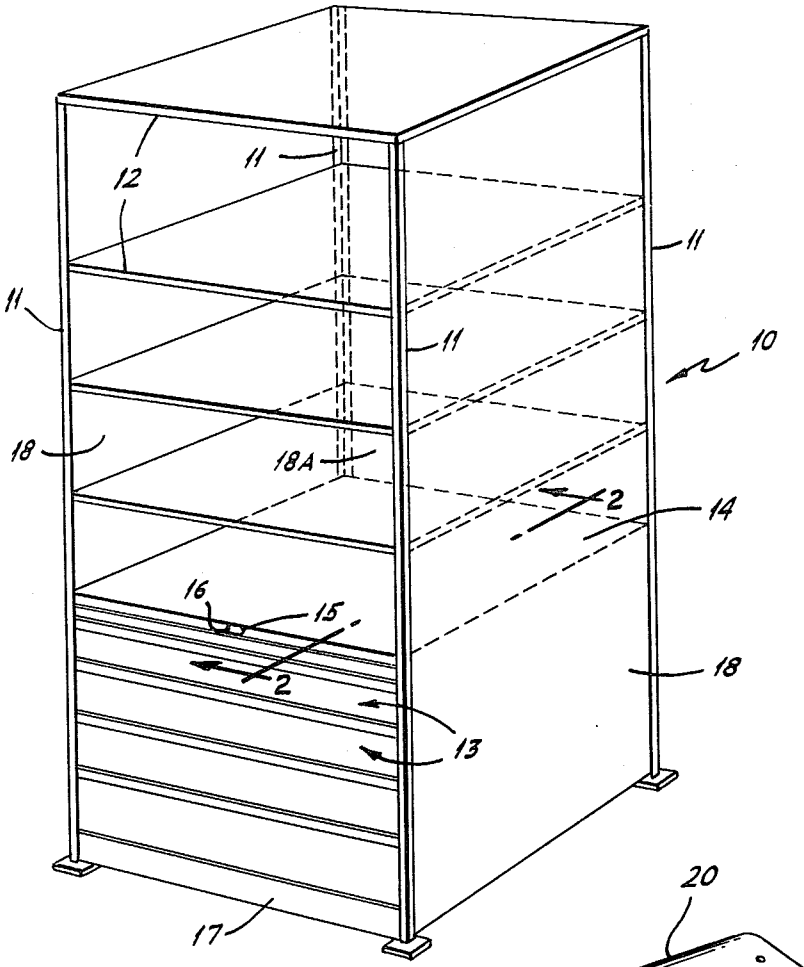
FIG. 1 is a front and side perspective view of a representative single shelving unit of the present invention.

Referring specifically to the drawings, FIG. 1 shows a representative unit 10 of a lockable storage system embodying features of the present invention. The unit includes four vertical support members 11 in which are mounted by any conventional means shelves 12 and in which are slidably mounted by any conventional means drawers 13. For purposes of illustration, only one such unit is shown; of course, depending on the storing user's desires, any number of these units may be joined together into an integrated storage system by utilizing certain support members 11 to support more than one unit. Depicted also in FIG. 1 is a top panel 14 covering entirely the open top of uppermost drawer 13, in which top panel is mounted an escutcheon 15 aiding in the mounting within the top panel of a locking mechanism 16 that will be described in detail in connection with FIG. 3. A front base spreader 17 is shown mounted under the lowest drawer 13. FIG. 1 shows the security afforded by top panel 14 to uppermost drawer 13, as well as that provided by a side panels 18 enclosing the respective sidewalls of all drawers 13. A rear panel 18A, which is similar to side panels 18, is mounted on the rear portion of the unit for security. The top panel, side panels and rear panel are mounted on the supports by suitable conventional means, such as carriage bolts, so that they may not be removed from the outside of the unit for security purposes.

Figure 2:
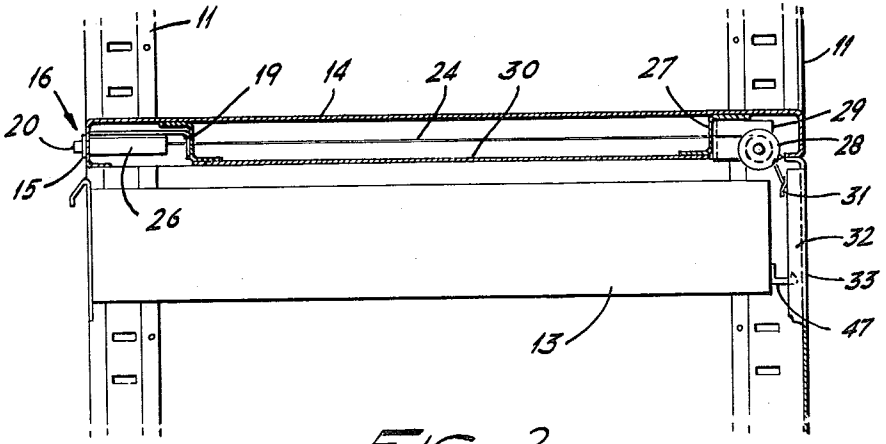
FIG. 2 is a fragmentary side elevation view of the top panel and locking mechanism housed therein taken along the line 2—2 of FIG. 1.
Figure 3:
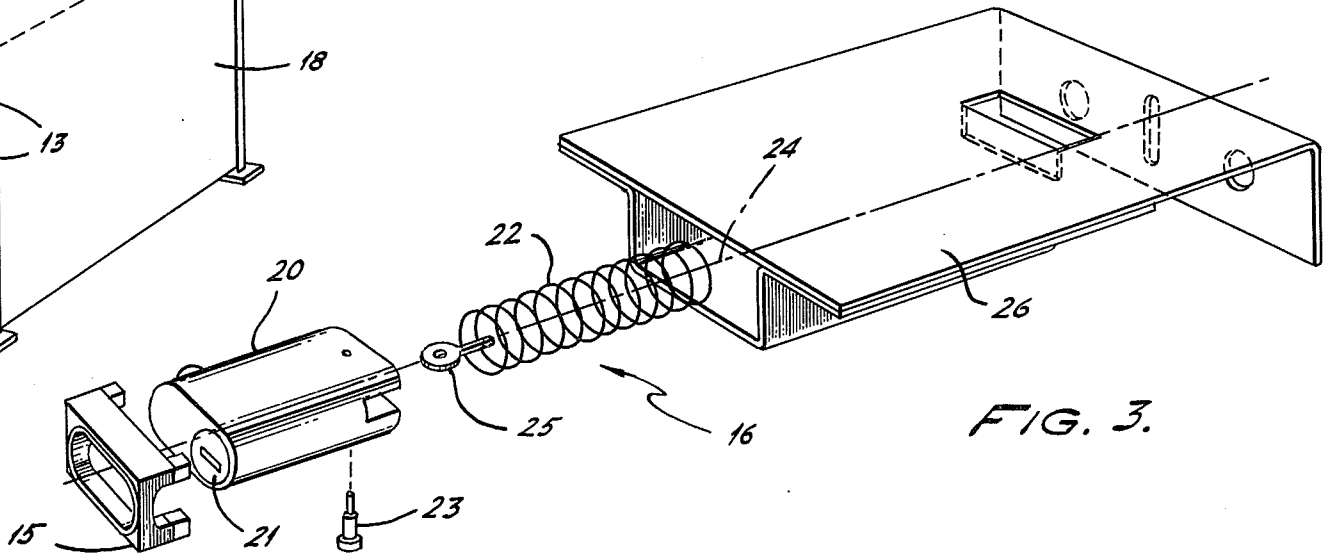
FIG. 3 is a perspective exploded view of the parts constituting a preferred embodiment of the locking mechanism shown in FIG. 2.

Referring to FIGS. 2 and 3, FIG. 2 shows the mounting of locking assembly 16 underneath top panel 14 by use of a front angle support 19 and appropriate conventional fasteners. FIG. 3 illustrates a preferred embodiment of locking assembly 16 by showing its disassembled parts: a standard plunger-type lock 20 having a key hole 21 for acceptance of an unlocking key (not shown), a biasing spring 22, a fastener 23 for connecting the end of a locking cable 24 through an eyelet 25 to the lock 20, and a lock assembly housing 26. Any standard locking mechanism with an ability to extert tension on locking cable 24 toward the front of the unit when the drawers are desired to be in the open and unlocked position may be substituted for this embodiment. Locking cable 24 traverses longitudinally and above the length of uppermost drawer 13 and passes through a guide aperture in a rear angle support 27 and over a roller 28 mounted on the rear angle support by means of a roller bracket 29, as shown in FIG. 2. In a preferred embodiment, locking cable 24 is protected from snagging and for security purposes by a locking cable cover 30 (shown cutaway in FIG. 2) mounted under top panel 14 in any convenient manner. The end of locking cable 24 at the rear of the unit is attached at a hook 31 on a locking channel 32 slidably mounted in a locking channel housing 33, the locking channel and its housing being shown in more detail in FIG. 5.

FIG. 4 shows, with rear panel 18A cutaway, the rear view of drawers 13 slidably mounted on supports 11 under top panel 14 and shows a rear base spreader 34 mounted between supports 11. Locking channel housing 33 is vertically mounted by suitable fastener means between top panel 14 and rear base spreader 34. Shown in FIG. 4 are rear wall surfaces 35 of drawers 13.

FIG. 5 is a disassembled view of the locking assembly showing locking channel 32 slidably mounted within locking channel housing 33. The locking channel is provided with hook 31 at its upper end, with a plurality of uniformly spaced slots 36, and with a spring retaining aperture 37 at its lower end. Locking channel housing 33 is provided with flanges 38 for attachment by suitable means to rear base spreader 34 and top panel 14, as well as a pin aperture 39 and a spring slot 40. Aperture 39 receives a cotter pin 41 which restrains one end of a biasing spring 42 to the housing. The other end of the spring 42 is connected through spring slot 40 in the housing to the locking channel at its spring retaining aperture 37. In the present preferred embodiment, the biasing strength of spring 42 must be less than that of spring 22 in order to allow proper operation on opening, closing, locking and unlocking the drawers, as will be explained in conjunction with FIG. 8.

FIG. 6 shows another preferred embodiment including an adjustable form of a locking channel housing **33*a* which may be used in the embodiment of FIGS. 1–5 to vary the number of drawers utilized by changing the height alloted to the total number of drawers through modification of the length of the rear locking assembly. In this embodiment, locking channel housing 33*a* is composed of upper locking channel housing 43 and lower locking channel housing 44, both having a plurality of uniformly spaced mateable apertures 45. The upper locking housing channel is slidable within the lower locking channel housing and may be restrained in one position with regard to the lower housing by any suitable fastening means inserted through pairs of mated apertures 45** to achieve a desired height of the assembly and, therefore, the use of a desired number of drawers.

Figure 7:
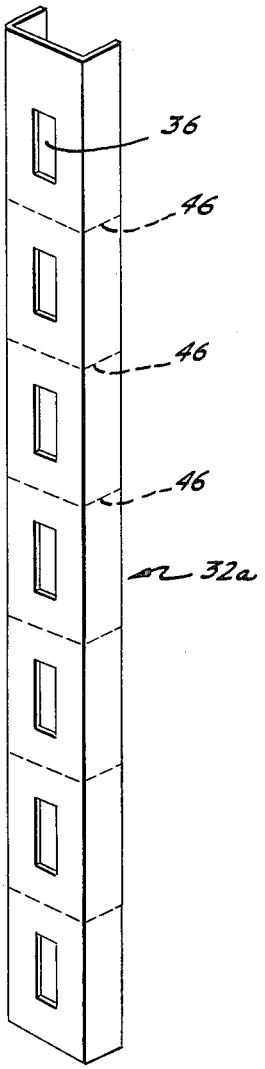
FIG. 7 is a front perspective view of an alternative adjustable form of locking channel.

FIG. 7 shows another embodiment of a locking channel **32*a* in which a plurality of grooves 46 have been precut horizontally in the locking channel to facilitate shortening the length of the channel to suit the length of the adjustable locking channel housing 33*a*, or the length of any pre-sized non-adjustable locking channel housing 33**, by cutting or breaking.

Figure 8:
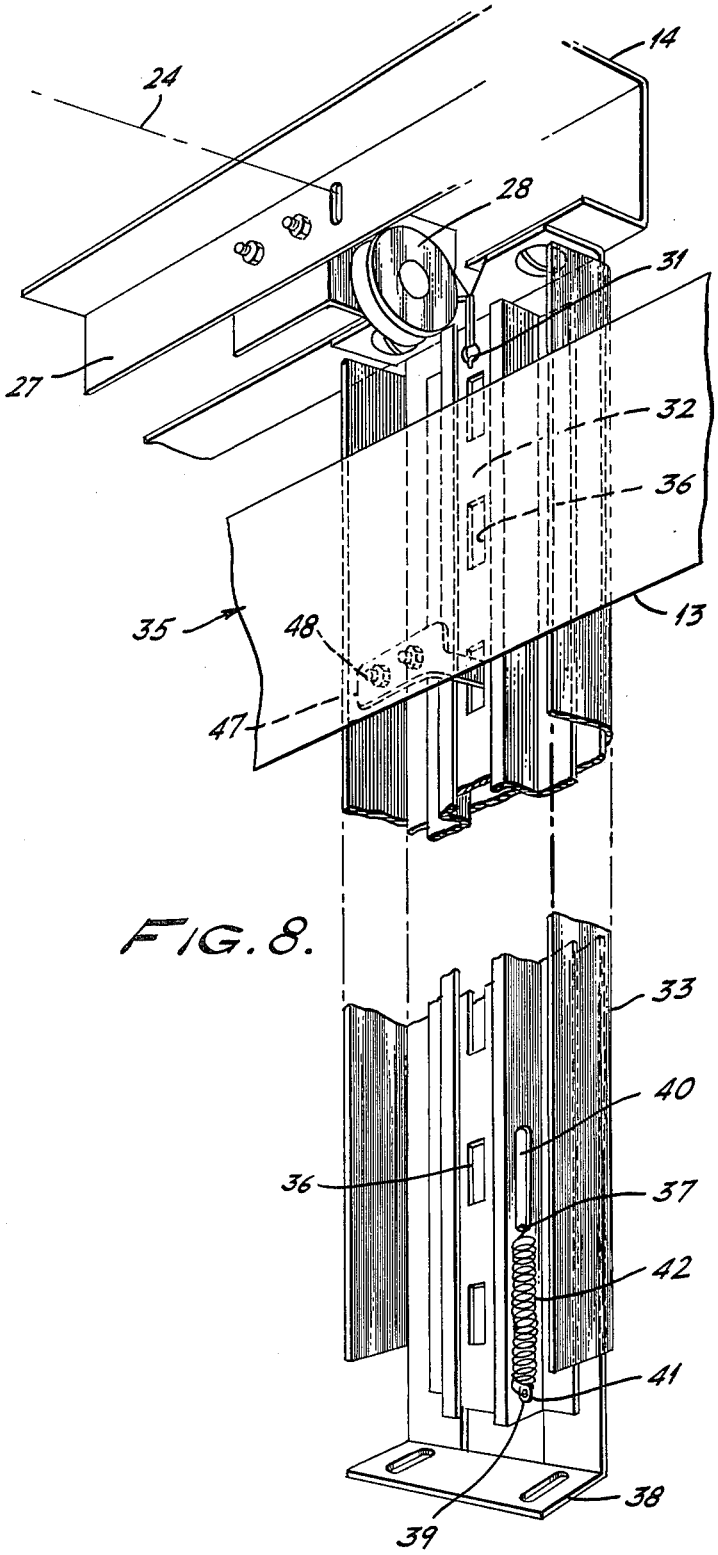
FIG. 8 is a broken front perspective view of a unit of FIG. 1 showing a locking channel slidably mounted in its housing and a locking pawl mounted on the rear wall of one of the drawers of the unit.
Figure 9:
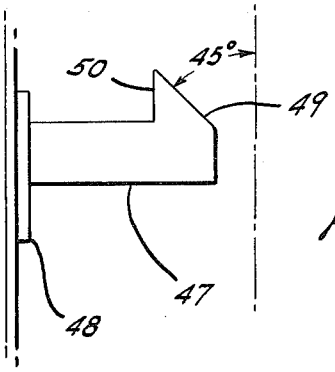
FIG. 9 is a side elevation view of a representative locking pawl mounted on the rear of a drawer as shown in FIG. 8.

FIG. 8 illustrates the cooperation of locking cable 24, locking channel 32, and a number of locking pawls 47 attached to the outside surfaces of the respective rear walls 35 of drawers 13 by use of a flange 48 on each pawl and by any suitable fastening means. FIG. 9 depicts a side view of one such locking pawl 47 to illustrate the 45 degree slope from the horizontal of the leading edge of arm 49 of the pawl, which design facilitates the closing and locking of any drawers that may have remained open at the time the locking assembly was placed in the locked position, as will be explained below.

Referring now to FIGS. 3 and 8, in the unlocked position of this preferred embodiment of the invention plunger type lock 20 is unlocked and is free to move toward the front of the unit, and spring 22 is therefore fully expanded. Spring 22, having a greater bias than that of spring 42, keeps locking cable 24 under tension in the direction of the front of the unit which in turn exerts an upward force on locking channel 32 bringing the channel into a pre-determined position whereby each locking pawl 47 may freely move through its respective slot 36 and there is no restriction on opening or closing the drawers. The drawers are not locked in this position. To lock the drawers in concert, all drawers are closed and lock plunger 20 is depressed. This compresses biasing spring 22 whose subsequent loss of tension allows spring 42 to maintain tension in a downward direction on the locking channel causing its slots 36 to move into a lower pre-determined position. The pawls, which are already as far to the rear of the unit as possible, become restrained by the locking channel from forward movement because back edges 50 (depicted in FIG. 9) of their arms 48 extend above the top of the respective slots in the locking channel. All drawers are therefore closed and locked. Drawers left in their open position during such locking operation, however, may also be closed and locked in accordance with the present invention. By the 45 degree design of arms 49 of the pawls and their back edges 50, on closing a drawer when the locking channel is already in the locked position an ever increasing width of the arm of the pawl on that drawer is inserted into its respective slot 36 of the locking channel thereby inching the top of the slot up the 45 degree incline and raising the channel against the bias of spring 42 until the arm is fully accepted into the slot. At the point of full acceptance, the channel is pulled by spring 42 down behind back edge 50, restraining the pawl and locking the drawer in place.

Having thus described several preferred embodiments of the present invention, some of its advantages should now become clear. Drawers used in conjunction with a shelving unit may be locked individually or in concert, providing security to complement flexibility in design of a storage system. Also, the number of drawers used may be varied according to the user's desire and needs by changing the adjustable rear locking mechanism, enhancing such flexibility of design.

We claim:

1. A storage system comprising: support means;

a plurality of shelves mounted in said support means;

a plurality of drawers slidably mounted in said support means, each drawer having a member mounted thereon; and adjustable locking means mounted on said support means and formed to be engageable with said drawer members for locking said drawers individually or in concert, said adjustable locking means comprising:

a locking channel housing mounted in said support means, comprising a first housing member, a second housing member, slidable within said first housing member for adjusting the length of said locking channel housing, and fastener means for restraining said first housing member within said second housing member;

a locking channel slidably mounted in said locking channel housing, having a plurality of slots therein for operatively engaging said members on said drawers;

means for moving said locking channel vertically; and biasing means for positioning said locking channel into a locked position whereby said members on said drawers extend through said openings in said locking channel and are engaged to lock said drawers by restricting their movement.

2. A storage system as described in claim 1 wherein said locking channel comprises a member having a plurality of horizontal spaced grooves to facilitate shortening the length of said member by removing a portion of said member.

* * * * *